United States Patent [19]

Nagasaka

[11] Patent Number: 4,883,007

[45] Date of Patent: Nov. 28, 1989

[54] NEEDLE CLAMP FOR SEWING MACHINE

[75] Inventor: Nobusuke Nagasaka, Haguri, Japan

[73] Assignee: Brother Kogyo Kabushiki Kaisha, Aichi, Japan

[21] Appl. No.: 308,444

[22] Filed: Feb. 10, 1989

[30] Foreign Application Priority Data

Mar. 1, 1988 [JP] Japan ..... 63-27064[U]

[51] Int. Cl.[4] ..... D05B 55/02

[52] U.S. Cl. ..... 112/226; 24/135 N

[58] Field of Search ..... 24/135 N; 439/810, 813; 112/226

[56] References Cited

U.S. PATENT DOCUMENTS

| | | | |
|---|---|---|---|
| 418,049 | 12/1889 | Muther | 112/226 |
| 423,113 | 3/1890 | Baker | 112/226 |
| 1,401,466 | 12/1921 | De Voe . | |
| 2,792,798 | 5/1957 | Zink | 112/226 |
| 3,020,866 | 2/1962 | Fujita . | |
| 3,348,508 | 10/1967 | Eguchi et al. . | |
| 4,111,139 | 9/1978 | Klundt . | |
| 4,508,042 | 4/1985 | Bianchi | 112/226 |

FOREIGN PATENT DOCUMENTS

| | | |
|---|---|---|
| 367062 | 4/1961 | Japan . |
| 41-330 | 2/1966 | Japan . |
| 51-32598 | 8/1976 | Japan . |
| 59-34781 | 3/1984 | Japan . |
| 59-34782 | 3/1984 | Japan . |
| 59-37986 | 3/1984 | Japan . |
| 62-165970 | 10/1987 | Japan . |

*Primary Examiner*—Andrew M. Falik

*Attorney, Agent, or Firm*—Oliff & Berridge

[57] ABSTRACT

A needle clamp includes a clamp screw, a square nut member having a threaded hole engageable with the clamp screw, and a needle clamp body having a first hole for receiving plural needles arranged in side-by-side relationship in a first direction within a predetermined plane, a second hole formed so that the clamp screw may move therein in the first direction, and a square cavity formed so that the nut member may move therein in the first direction. The cavity includes a pair of opposite internal walls which prevent the nut member from rotating about an axis of the clamp screw by engaging with corners of the nut member, and a third internal wall which prevents the nut member from moving away from the needles arranged in the first hole by engaging with a surface of the nut member opposite to a surface facing the arranged needles. Consequently, when the clamp screw is tightened within the threaded hole of the nut member, a conical end portion of the clamp screw is automatically positioned at the middle position between two adjacent needles, so that the needles are simultaneously firmly attached to the needle clamp body. When the clamp screw is loosened, the nut member is prevented from falling off or from blocking the insertion of needles by means of its engagement with the clamp screw.

8 Claims, 5 Drawing Sheets

NEEDLE CLAMP FOR SEWING MACHINE

FIELD OF THE INVENTION

The present invention relates to a needle clamp for sewing machines and, in particular, to a needle clamp capable of attaching plural needles to a lower end portion of a needle bar with one clamp screw.

BACKGROUND OF THE INVENTION

A conventional needle clamp of the type described above is disclosed in Japanese Utility Model No. 36-7062. Such a needle clamp comprises a clamp body and a clamp screw which engages with a threaded hole of the clamp body. In order to attach plural needles to a needle bar, the needles are inserted into a hole provided in the clamp body. Thereafter, the clamp screw is tightened within the threaded hole so that peripheral surfaces of the needles are wedged against an internal surface of the hole by a tapered end portion of the clamp screw.

In such a conventional needle clamp, however, it is relatively difficult to precisely machine the threaded hole for the clamp screw at a required position. If an axis of the machined threaded hole deviates from the middle position of two needles arranged side by side, the tapered portion of the clamp screw is displaced toward one needle and off of the middle position. As a result, both needles are not firmly attached to the needle bar with one clamp screw.

In order to overcome the foregoing disadvantage, an improved needle clamp has been proposed in Laid-open Japanese Publication No. 59-37986. In the proposed clamp, a spacer member is placed between a clamp screw and two needles arranged side by side. When the clamp screw is tightened, a tapered portion of the spacer member is guided along peripheral surfaces of the needles and is moved to the middle position of the needles, so that the tapered portion presses both needles simultaneously.

The needle clamp proposed in Japanese Patent No. 597986 still suffers from a substantial deficiency. The spacer member must be pivotally mounted on the needle bar so as to prevent the spacer member from falling off or from blocking the insertion of needles. Thus, construction of the needle clamp and the needle bar is complicated, rendering it difficult to machine the needle bar and to attach the needle clamp to the needle bar.

SUMMARY OF THE INVENTION

Accordingly, it is an object of the present invention to provide a needle clamp for sewing machines capable of firmly attaching plural needles with one clamp screw in a simple construction.

In order to accomplish the above-mentioned object, the needle clamp according to the present invention comprises a clamp body secured to a lower end portion of a needle bar and having a first hole for receiving plural needles in side-by-side relationship in a first direction within a predetermined plane and a second hole communicating with the first hole in a second direction substantially perpendicular to the predetermined plane; a clamp screw positioned within the second hole and having a conical end portion engageable with peripheral surfaces of two adjacent needles of the plural needles, a diameter of the clamp screw being smaller than a dimension of the second hole in the first direction so that the clamp screw moves in the first direction; a nut member threaded to engage with the clamp screw and disposed on the clamp body so as to move in the first direction; means for preventing the nut member from rotating about an axis of the clamp screw; and means for preventing the nut member from moving in the second direction away from the plural needles received in the first hole.

In the needle clamp having the foregoing construction, the clamp screw engages with the threads of the nut member movable in the first direction. When the clamp screw is tightened in the nut member, the conical end portion of the clamp screw is guided by the peripheral surfaces of the needles and is shifted to the middle position between the needles, so that both needles are pressed simultaneously by the conical end portion.

The clamp screw engaging with the nut member is received in the second hole, thereby preventing the nut member from falling off of the clamp body even if the clamp screw is loosened to detach the needles. Further, the needle clamp of the present invention has a decreased number of parts, so that the needle clamp may be produced at reduced cost and is easy to attach to the needle bar.

BRIEF DESCRIPTION OF THE DRAWINGS

The above and other objects, features and advantages of the present invention will become more apparent from reading the following description of the preferred embodiments taken in connection with the accompanying drawings in which.

DESCRIPTION OF THE PREFERRED EMBODIMENTS

Figure 1:
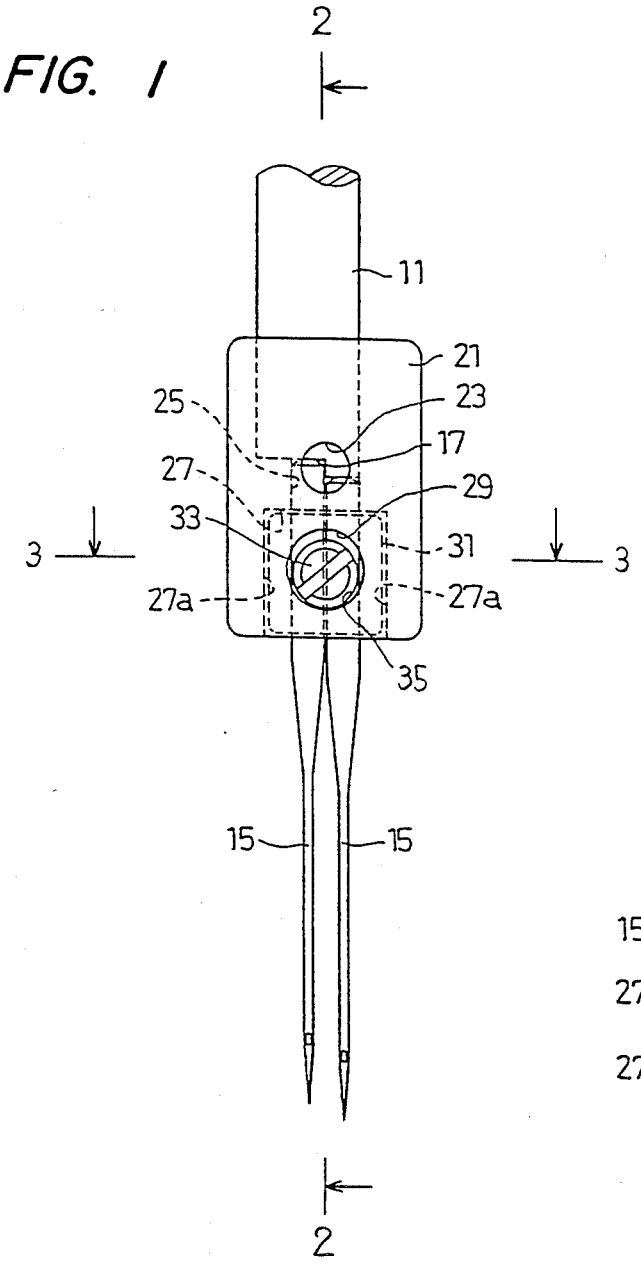
FIG. 1 is a front elevational view of an embodiment of a needle clamp according to the present invention.
Figure 3:
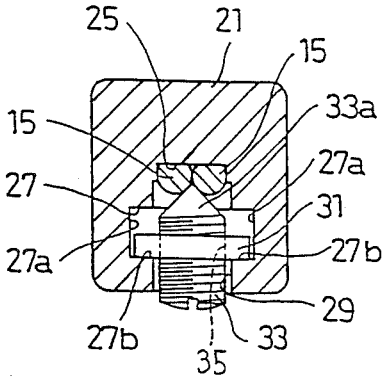
FIG. 3 is a cross-sectional view taken along the line 3—3 of FIG. 1.
Figure 2:
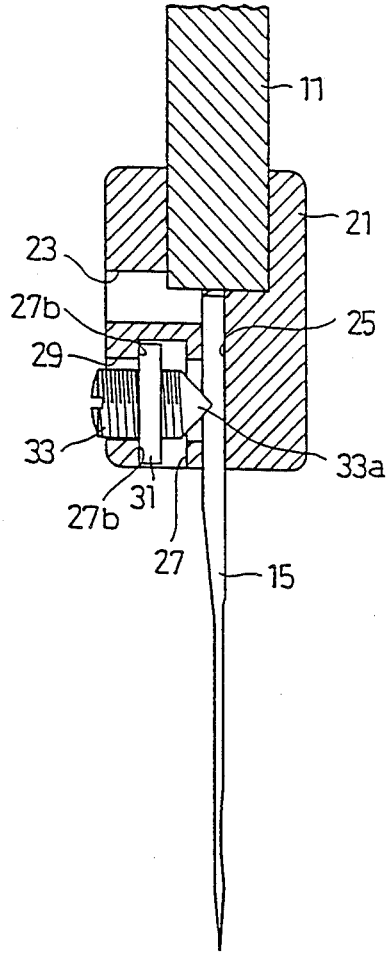
FIG. 2 is a cross-sectional view taken along the line 2—2 of FIG. 1.

Referring to the accompanying drawings, a first embodiment of the needle clamp according to the present invention will now be explained with reference to FIGS. 1-3.

A needle bar 11 is provided with a step portion 17 for positioning two needles 15, 15 in a vertical direction by means of engagement with lower end surfaces of the step portion 17. A needle clamp body 21 is secured to a lower end portion of the needle bar 11.

The clamp body 21 is provided with a window 23 extending from a front surface of the clamp body 21 toward the step portion 17 in a horizontal direction so that the setting of both needles 15, 15 may be checked through the window 23. A hole 25 is formed in the clamp body 21 so as to extend upwardly from a lower surface of the clamp body 21 to the step portion 17. The needles 15, 15 are inserted in the clamp body 21 through the hole 25 A square cavity 27 is formed in the clamp body 21 so as to extend upwardly from the lower end surface of the clamp body 21, and a nut member 31 is inserted in the clamp body 21 through the cavity 27. Further, the clamp body 21 is provided with a hole 29 extending from the front surface of the clamp body 21 toward the hole 25 in a horizontal direction so that a clamp screw 33 may be inserted in the clamp body 21 through the hole 29.

The nut member 31 preferably comprises a square plate provided with a threaded hole 35 in its center portion. The width of one side of the nut member 31 is set smaller than the width of the cavity 27 so that the nut member 31 may move right and left in the cavity 27. The length of a diagonal of the nut member 31 is set larger than the width of the cavity 27, so that the nut member 31 is prevented from rotating about an axis of the threaded hole 35 by contact between the nut member 31 and right and left internal walls **27*a* of the cavity 27**.

In addition, the width of the nut member 31 is larger than the diameter of the hole 29. The nut member 31 is therefore prevented from moving away from the plural needles 15, 15 in an axial direction of the hole 29 by contact between the nut member 31 and internal wall **27*b* of the cavity 27 adjacent an entrance of the hole 29**.

The clamp screw 33 is formed with a diameter smaller than the diameter of the hole 29, and is engaged with the threaded hole 35 of the nut member 31. An end portion **33*a* of the clamp screw 33 is formed in a conical shape, so that the two needles 15, 15 are wedged against an internal wall of the hole 25 when the end portion 33*a* is forced between needles 15, 15 by tightening of clamp screw 33 as shown in FIG. 3**.

The operation of the needle clamp constructed as described above will now be explained.

An operator inserts two needles 15, 15 into the needle clamp body 21 through the hole 25 until the top end of each needle 15 reaches the step portion 17 provided on the lower end portion of the needle bar 11, and then tightens the clamp screw 33 in the threaded hole 35 of the nut member 31. By means of such operations, the end portion **33*a* of the clamp screw 33 is forced between the two needles 15, 15. Consequently, the two needles 15, 15 are simultaneously wedged against the internal surface of the hole 25 and are thereby attached to the needle clamp body 21**.

Even if the end portion **33*a* is displaced to the side of either of the two needles 15, 15 off of the middle position between the needles 15, 15, upon tightening the clamp screw 33 the end portion 33*a* comes into contact with a peripheral surface of one of the needles 15, 15 and thereafter moves right or left along the peripheral surface together with the nut member 31 so as to become positioned at the middle position between the needles 15, 15. Accordingly, despite any setting of the end portion 33*a* off of the middle position upon attaching the needles 15, 15, the end portion 33*a* is automatically positioned at the middle position upon tightening of the clamp screw 33 so that the two needles 15, 15 may be simultaneously firmly attached to the needle clamp body 21** in side-by-side relationship.

Further, attachment of only one needle 15 may be accomplished in this embodiment, because a range of play of the nut member 31 in a horizontal direction and a tilt of the end portion **33*a* are predetermined so that the end portion 33*a* may be kept in engagement with the peripheral surface of the needle 15 while the needle 15 is received in the hole 25**.

Figure 4:
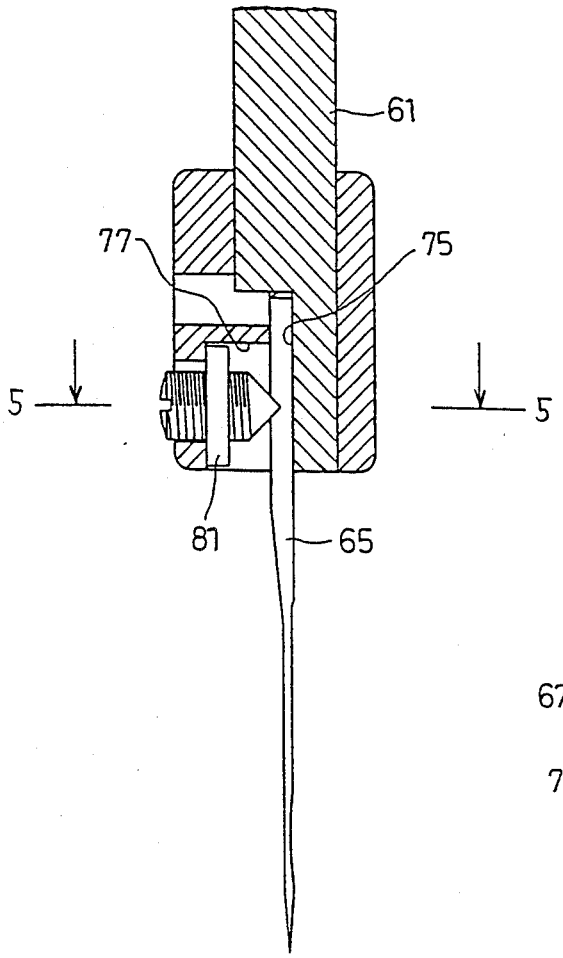
FIG. 4 is a cross-sectional view showing another embodiment of the needle clamp of the present invention.
Figure 5:
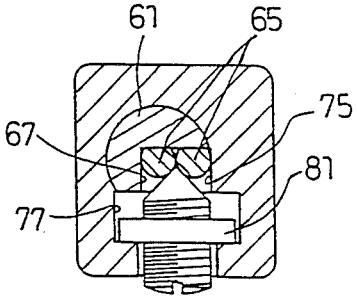
FIG. 5 is a cross-sectional view taken along the line 5—5 of FIG. 4.

Although the hole 25 and the cavity 27 are separately provided in the needle clamp body 21 in the first embodiment, an integral hole 75 and cavity 77 may be provided for receiving needles 65, 65 and a nut member 81 as shown in the second embodiment of FIGS. 4 and 5. In addition, a part or all of an internal wall of the hole 75 for receiving the needles 65, 65 may comprise vertical surfaces of a lower end portion of a needle bar 61.

Figure 6:
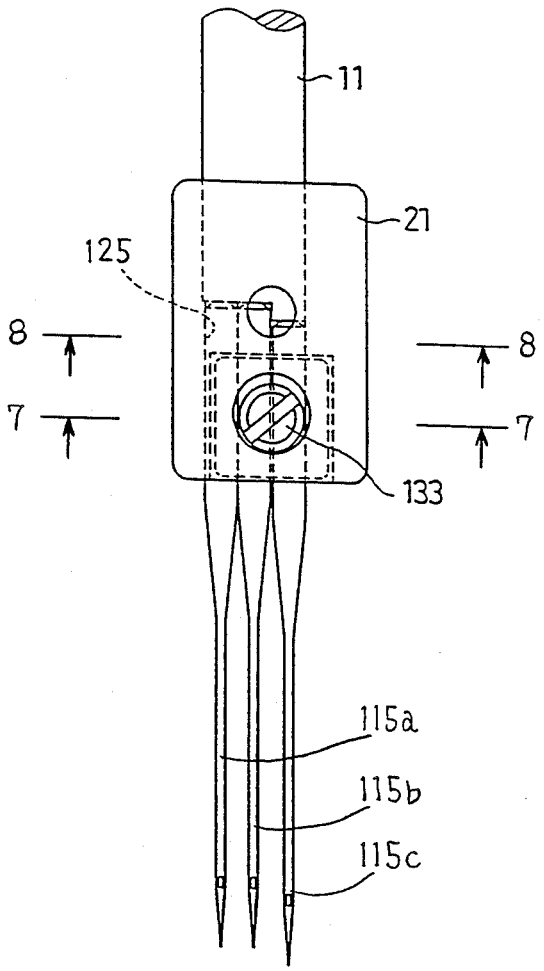
FIG. 6 is a front elevational view showing a further embodiment of the needle clamp of the present invention.
Figure 7:
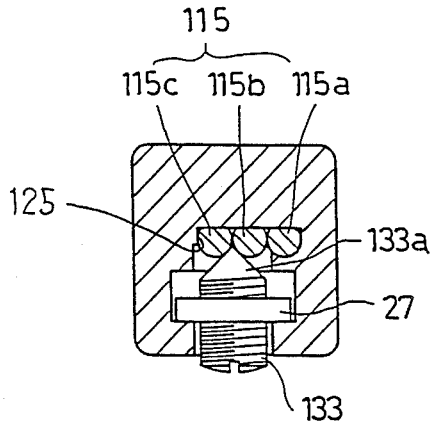
FIG. 7 is a cross-sectional view taken along the line 7—7 of FIG. 6.
Figure 8:
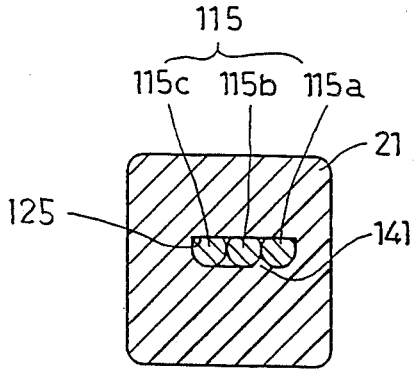
FIG. 8 is a cross-sectional view taken along the line 8—8 of FIG. 6.

Further, the first two embodiments are described with reference to a case where two needles 15, 15 are attached to the needle clamp body 21, but the present invention also may be applied to a case where three needles 115 are attached as shown in the third embodiment of FIGS. 6–8. In this case, a protrusion 141 is provided on an internal wall of a hole 125 at a position between two adjacent needles **115*a*, 115*b*, and an end portion 133*a* of a clamp screw 133 is forced between two adjacent needles 115*b*, 115*c*. In a needle clamp thus constructed, the needle 115*a* is out of contact with the clamp screw 133 when the screw 133 is tightened, and is prevented from moving to the left in FIG. 8 by the protrusion 141. Accordingly, the needles 115*b*, 115*c* are wedged directly by the end portion 133*a*, and the needle 115*a* is wedged through the needle 115*b* by the end portion 133*a*, so that the needles 115*a*, 115*b*, 115*c* are simultaneously firmly attached to the needle clamp body 21**.

It should be understood that the present invention is not limited to the above description, but is subject to modifications, alterations and equivalent arrangements within the scope of the appended claims. Thus, while only certain embodiments of the invention have been specifically described herein, it will be apparent from the above teachings that numerous modifications may be made thereto without departing from the spirit and scope of the invention.

What is claimed is:

1. A needle clamp for attaching plural needles to a needle bar of a sewing machine, comprising:

a clamp body secured to a lower end portion of said needle bar and having a first hole for receiving said plural needles in side-by-side relationship in a first direction within a predetermined plane and a second hole communicating with said first hole in a second direction substantially perpendicular to said predetermined plane;

a clamp screw positioned within said second hole and having a threaded shaft portion and a conical end portion engageable with peripheral surfaces of two adjacent needles of said plural needles, a diameter of said threaded shaft portion being smaller than a dimension of said second hole in said first direction so that said clamp screw moves in said first direction;

a nut member threaded to engage with said threaded shaft portion of said clamp screw and disposed in said clamp body so as to move in said first direction;

means for preventing said nut member from rotating about an axis of said clamp screw; and means for preventing said nut member from moving in said second direction away from said plural needles received in said first hole.

2. A needle clamp according to claim 1, wherein said nut member is received in a cavity formed between said first hole and an entrance of said second hole.

3. A needle clamp according to claim 2, wherein a dimension of said cavity is larger than a dimension of said nut member in said first direction.

4. A needle clamp according to claim 3, wherein said nut member is formed in a quadrangular shape, a length of a diagonal of which is larger than a dimension of said cavity in at least one of said first direction and a direction perpendicular thereto, and said rotating preventing means comprises opposite internal walls of said cavity which are substantially perpendicular to said predetermined plane and engageable with corners of said nut member.

5. A needle clamp according to claim 2, wherein a dimension of said nut member is larger than a dimension of said entrance of said second hole in at least one of said first direction and a direction perpendicular thereto, and said moving preventing means comprises an internal wall of said cavity which is substantially parallel to said predetermined plane and engageable with said nut member.

6. A needle clamp for attaching plural needles to a needle bar of a sewing machine, comprising:

a clamp body secured to a lower end portion of said needle bar and having a first hole for receiving said plural needles in side-by-side relationship in a first direction within a predetermined plane and a second hole communicating with said first hole in a second direction substantially perpendicular to said predetermined plane, said clamp body having a quadrangular cavity formed between said first hole and an entrance of said second hole, a dimension of each side of said cavity being larger than a diameter of said second hole, said cavity having a pair of opposite internal walls substantially perpendicular to said predetermined plane and a third internal wall substantially parallel to said predetermined plane;

a clamp screw disposed within said second hole and having a conical end portion engageable with peripheral surfaces of two adjacent needles of said plural needles, said clamp screw being smaller than said second hole in diameter so as to move in said first direction; and a quadrangular nut member threaded to engage with said clamp screw and received in said cavity, a dimension of said nut member being smaller than a dimension of said cavity in said first direction, and a length of a diagonal of said nut member being larger than the diameter of said second hole and a dimension of said cavity in at least one of said first direction and a direction perpendicular thereto;

whereby said pair of internal walls of said cavity engage with corners of said nut member to prevent said nut member from rotating about an axis of said clamp screw, and said third internal wall of said cavity engages with a surface of said nut member opposite a surface of said nut member facing said plural needles to prevent said nut member from moving in said second direction away from said plural needles received in said first hole.

7. A needle clamp according to claim 6, wherein one side of said cavity is open for insertion of said nut member into said cavity.

8. A needle clamp according to claim 6, wherein said clamp body further includes a window for checking positions of top end portions of said plural needles received in said first hole.

* * * * *